US006158494A

United States Patent [19]

Huang

[11] Patent Number: 6,158,494

[45] Date of Patent: Dec. 12, 2000

[54] WINDING DEVICE FOR WINDOW COVERING

[76] Inventor: Shien-Te Huang, P.O. Box 82-144, Taipei, Taiwan

[21] Appl. No.: 09/320,627

[22] Filed: May 27, 1999

[30] Foreign Application Priority Data

Jun. 19, 1998 [TW] Taiwan ..... 87209854

[51] Int. Cl.[7] ..... A47H 5/00

[52] U.S. Cl. ..... 160/84.05; 160/173 R; 160/171 R

[58] Field of Search ..... 160/171 R, 170 R, 160/84.04, 168.1 R, 173 R, 84.05

[56] References Cited

U.S. PATENT DOCUMENTS

| | | | |
|---|---|---|---|
| 3,181,595 | 5/1965 | Pender | 160/171 R |
| 3,310,099 | 3/1967 | Hunter et al. | 160/171 R |
| 3,352,349 | 11/1967 | Hennequin | 160/171 R |
| 5,103,888 | 4/1992 | Nakamura | 160/171 R |
| 5,839,494 | 11/1998 | Judkins | 160/171 R |

FOREIGN PATENT DOCUMENTS

| | | | |
|---|---|---|---|
| 1509779 | 7/1970 | Germany | 160/171 R |

*Primary Examiner*—Blair M. Johnson
*Attorney, Agent, or Firm*—A & J

[57] ABSTRACT

The inventive winding device comprises a transmission shaft, a plurality of thread shafts, a plurality of fixing stages and a plurality of cords. The plurality of cords are fixed on corresponding thread shafts, and by the synchronous rotation of the thread shafts with the transmission shaft and the relative rotation and movement of the thread shafts with respect to the fixing stage, the cords can be uniformly wound along the thread of the corresponding thread shafts. Therefore, both ends of the curtain can be moved symmetrically. The thread shafts and the transmission shaft do not need to assemble first, the assembling task is simplified. The lowest point is more definite such that the curtain can be easily controlled by machine.

1 Claim, 5 Drawing Sheets

WINDING DEVICE FOR WINDOW COVERING

FIELD OF THE INVENTION

The present invention relates to a winding device for window covering, more particularly, to a winding device for the window covering with pall.

BACKGROUND OF THE INVENTION

The window covering with rewindable pall generally requires guiding cord to lift or lower the pall thereof. Therefore, the smoothness of the cord operation will influence the operation of those window coverings.

FIG. 1 shows a headrail hardware for hanging window coverings described in U.S. Pat. No. 4,623,012. As shown in this figure, a plurality of cords 13 are fixed on the chip 12 of a capstan 11 with one end thereof. The capstan 11 supported by a plurality of brackets 14 winds the cord 13 on the outer surface thereof in single layer when being driven by an output axis 10. The capstan 11 begins to move laterally when sufficient friction has developed between the capstan and the cord which has been wound on to it. This provides space for the cord to wind onto the capstan in a single layer. When the pall is lowered to the lowest point and the output axis 10 is rotated in the same direction, then cord 13 will be wound on the capstan 11 reversely, thus lifts again the pall.

However, there are several problems in the conventional lifting device.

First, two or more cords are required to wind/loose the pall such that the cord near the driving means has larger torque and the cord far from the driving means has smaller torque. Therefore, both ends of the pall will be wound to different height. The problem is more serious when the pall is wound to a higher position.

Second, the cross-section capstan is hard to be a perfect circle by manufacture. Therefore, the fore is hard to uniformly exert onto the capstan.

Third, the pall can be kept winding such that the cord is reversely wound when the pall is at the lowest point. However, the lowest point is hard to define especially when a machine-control is used.

Fourth, the plurality cords are arranged on the capstan by a plurality of clips, the assembling of those cords and clips on the capstan is troublesome.

It is the object of the invention to provide a lifting device for window covering, by which the cords can be uniformly wound, the assembling can be simplified and the winding operation can be stopped at the lowest point.

In an aspect of the invention, the invention device has thread shaft with stop part which axially arranged on and moves synchronously with a transmission shaft. Each of the plurality of cords is fixed on corresponding thread shaft, wherein the outer thread of the thread shaft is matched with the inner thread of the through hole of the fixing stage. The thread shafts are driven by the transmission shaft and rotated, moved forward/backward by the counter action of the thread part of the fixing stage. The thread shaft can receive the cord with the same length and move the pall simultaneously. At the same time, the cord is wound around the groove of the outer thread of the thread shaft. The thread shaft and the transmission shaft of the present invention are slidably arranged other than fixed such that they can be assembled in either order. Therefore, both ends of the pall can be ensured to have same height and the assembling and manufacturing thereof are simplified.

To achieve above object, the inventive lift device comprises a transmission shaft linked with a driving means; a plurality of thread shaft with hole slidably arranged on the transmission shaft to rotate synchronously with the transmission shaft, each thread shaft having outer thread and a stop part on one end thereof; a plurality of fixing stage on the curtain body, each fixing stage housing one thread hole of the corresponding thread shaft and having inner thread corresponding to the outer thread of the thread shaft; and a plurality of cords, each fixed on one corresponding thread shaft.

The various objects and advantages of the present invention will be more readily understood from the following detailed description when read in conjunction with the appended drawing, in which:

DETAILED DESCRIPTION OF PREFERRED EMBODIMENT

Figure 1:
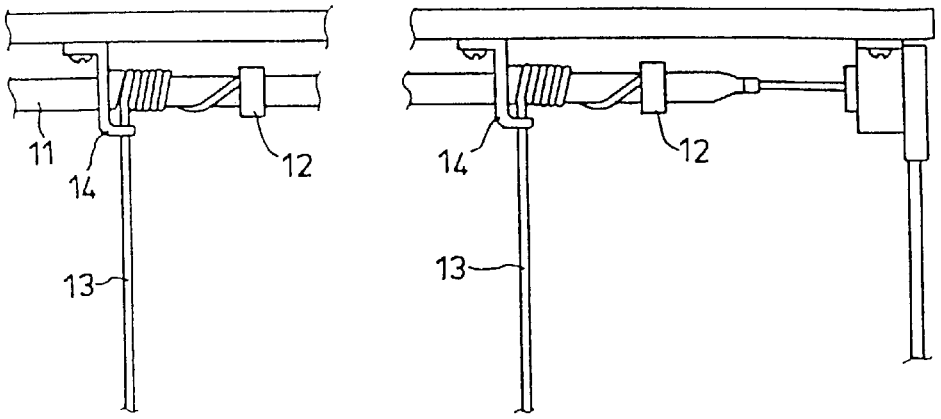
PRIOR ART FIG. 1
FIG. 1 is the cross-section view of prior art.
Figure 2:
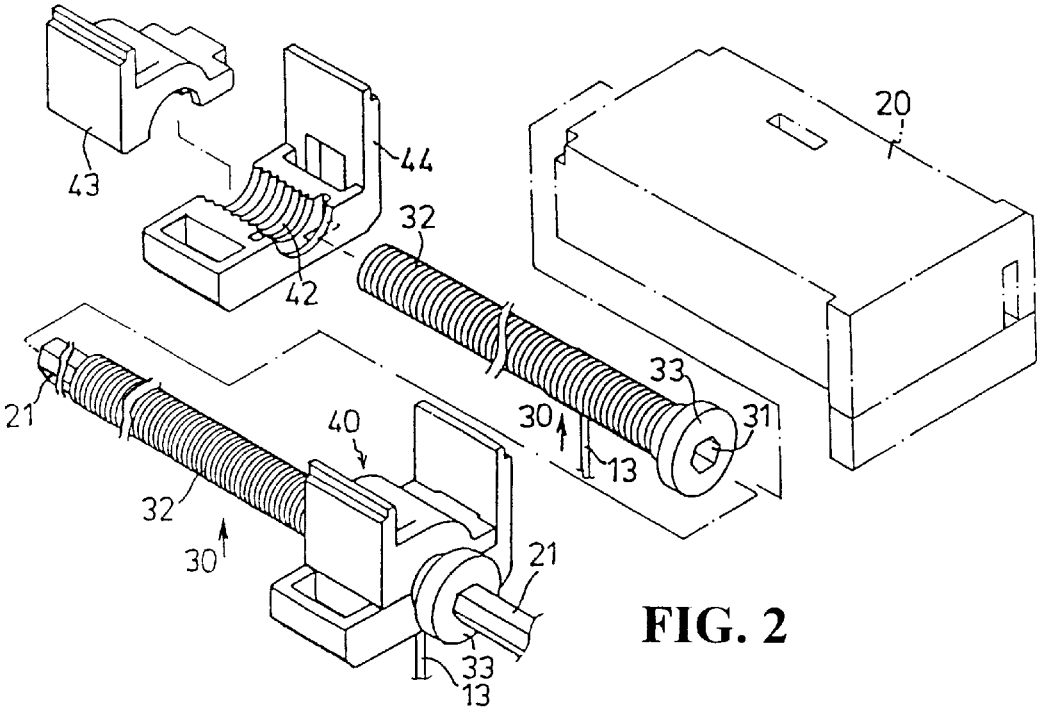
FIG. 2 shows the exploded view of the first embodiment.

With reference now to FIG. 2, the first embodiment comprises a transmission shaft 21, two thread shafts 30, two fixing stages 40, and two cords 13.

The transmission shaft 21 has hexagonal cross section and is connected to a driving means 20 to transmit the driving power of the driving means 20.

Each of the two thread shafts 30 has an axially arranged hexagonal hole 31 to engage with the outer side of the hexagonal transmission shaft 21 such that the thread shafts 30 rotate with the transmission shaft 21. Each thread shaft 21 has outer thread on outer surface thereof and has a stop part 33 on one side. Each of the two sets of fixing stages 40 comprises two sub-parts 43 and 44 such that a through hole 41 is formed to contain the thread shaft 30 when two sub-parts 43 and 44 merge. The through hole 41 has inner thread 32 to connect with the outer thread 32 of the thread shaft. The lower part 44 of each fixing stage has a guiding opening 47 such that two fixing stages 40 are arranged on predetermined positions of the curtain body. Each of the two cords 13 is connected to the leaf of the curtain, and one end thereof is connected to the stop part 33 through the opening 47.

Figure 3:
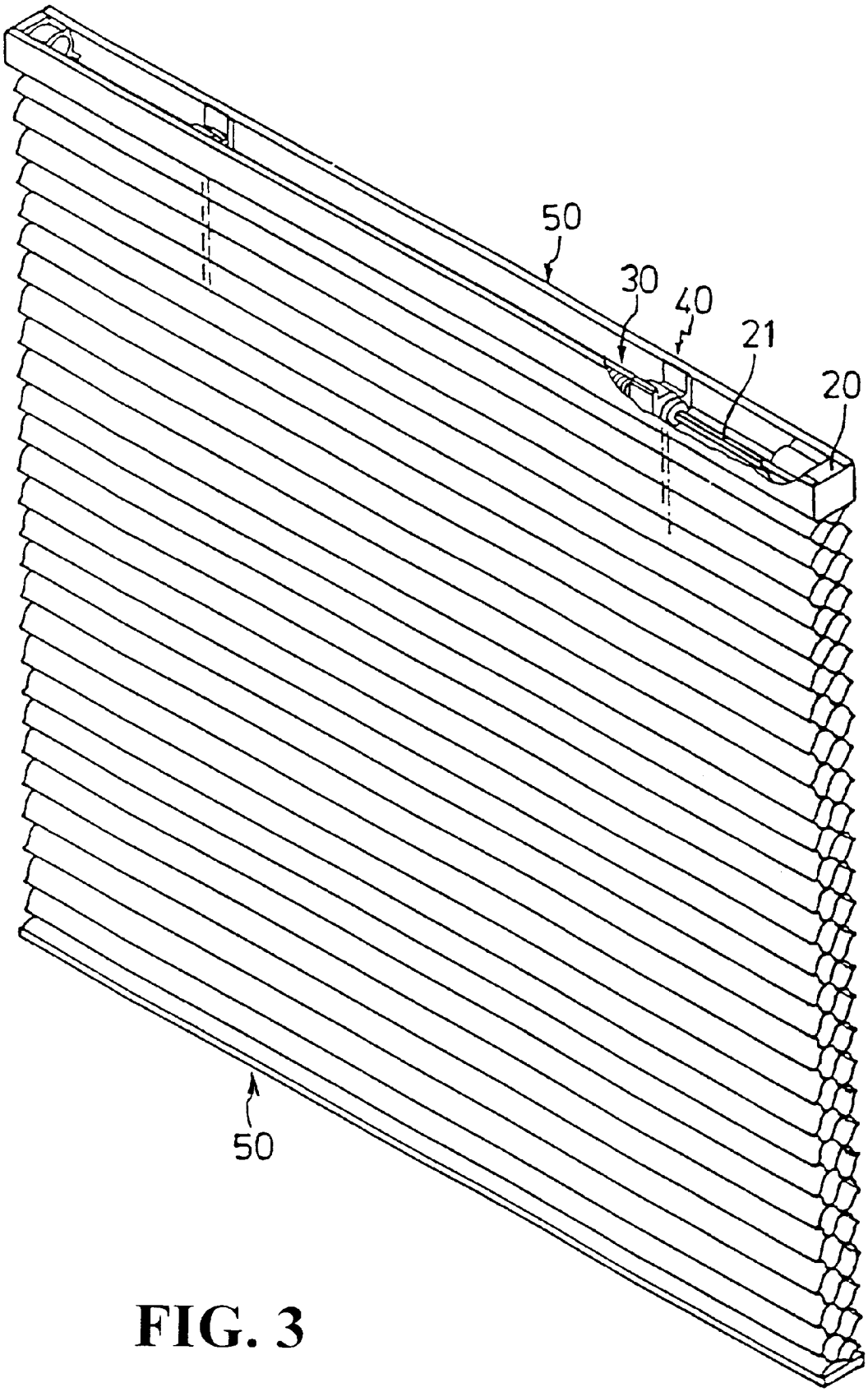
FIG. 3 shows that the first embodiment is arranged on a curtain.

As shown in FIG. 3, the inventive lifting device is arranged on the upper rack 51 of the curtain 50.

Figure 4:
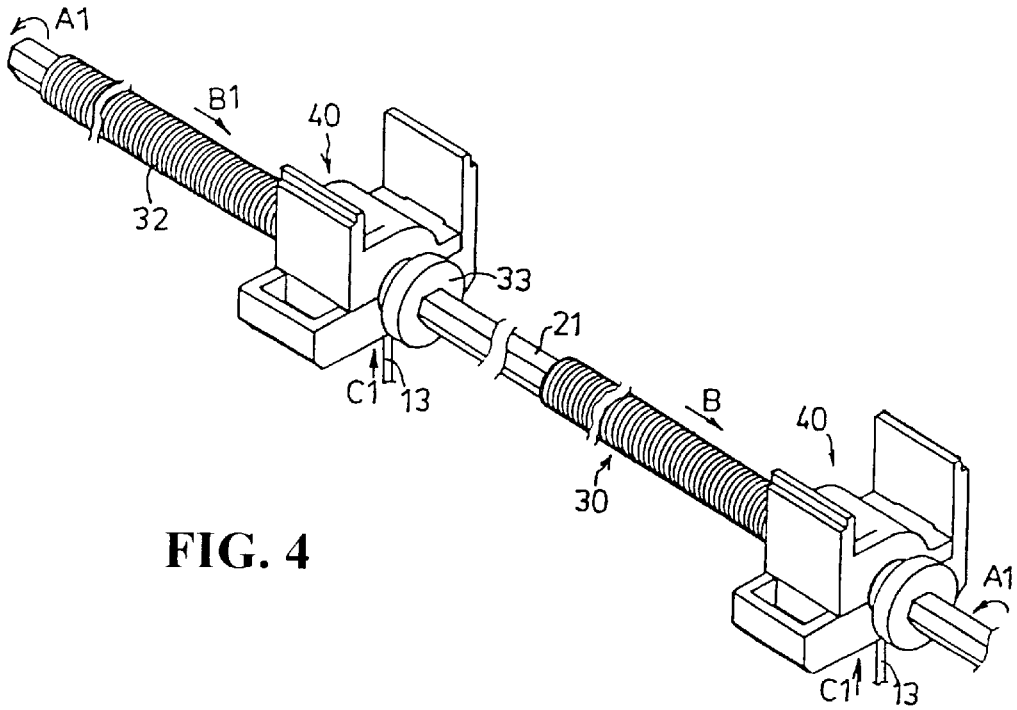
FIG. 4 is an exploded view showing the stage of the first embodiment wherein the pall is lowered down.

With reference now to FIG. 4, the cord 13 is released and the stop part 33 of the thread shaft 30 abuts on one side of the fixing stage 40 when the curtain 40 is lowered down. When the cord 13 is to be wound along direction C1 to lift the curtain, the driving means drives the transmission shaft 21 toward the direction A1 and drives the thread shaft 30 simultaneously The thread shaft 30 is pushed toward direction B1 by the count action of the fixing stage 40 and slides relative to the transmission shaft 21. The thread shaft 30 moves relative the fixing stage 40 and projects out of the groove of the outer thread 32 such that the wound cord 13 is wrapped around the groove.

Figure 5:
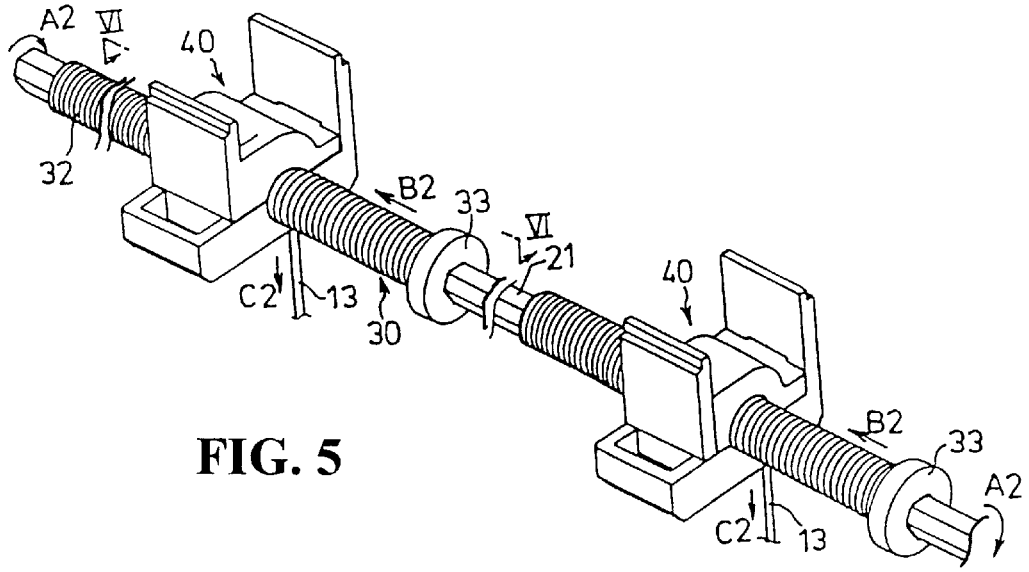
FIG. 5 is an exploded view showing the stage of the first embodiment wherein the pall is lifted.
Figure 6:
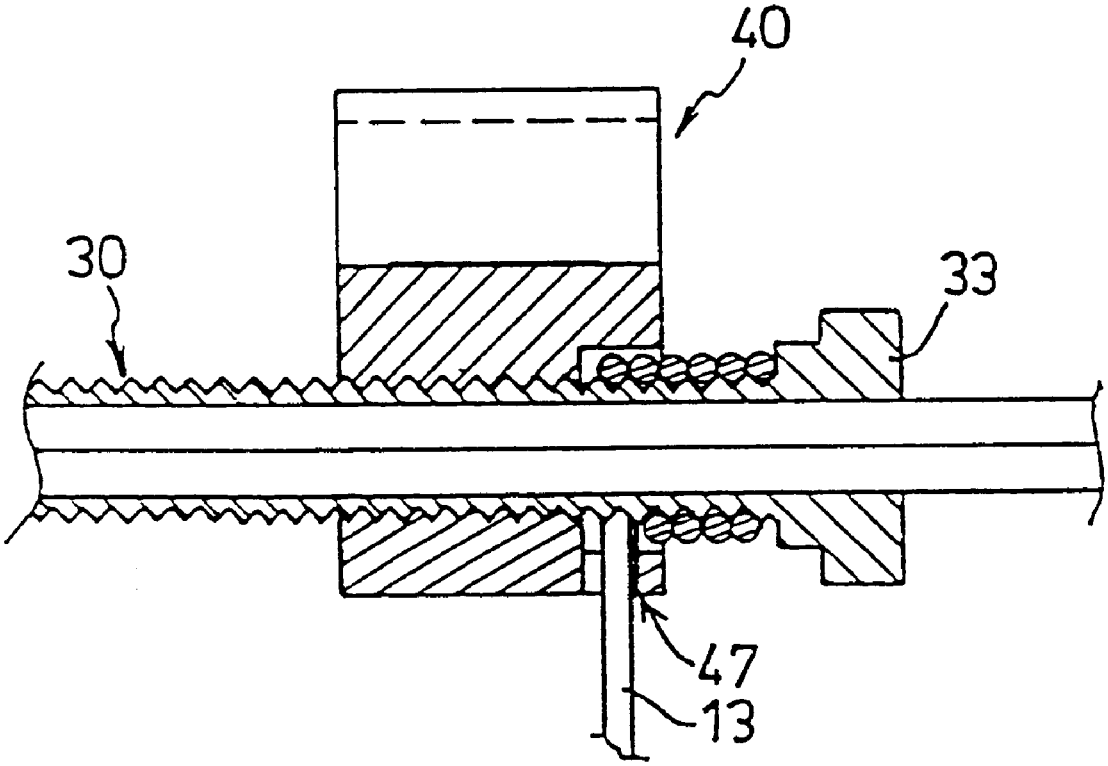
FIG. 6 shows the cross section view of FIG. 5 along VI—VI.

With reference now to FIGS. 5 and 6, when the lifted curtain is to be lowered, the cord 13 wrapped around the groove is released toward the direction C2, the driving means drives the transmission shaft 21 toward direction A2, the thread shaft 30 synchronously releases the cord 13 around the groove of the thread shaft 32. The thread shaft 30 is pushed toward direction B2 by the counter action of the fixing stage 40 until the stop part 33 abuts one side of the fixing stage, the cord 13 is completely released, and the curtain is down to the lowest point.

Figure 7:
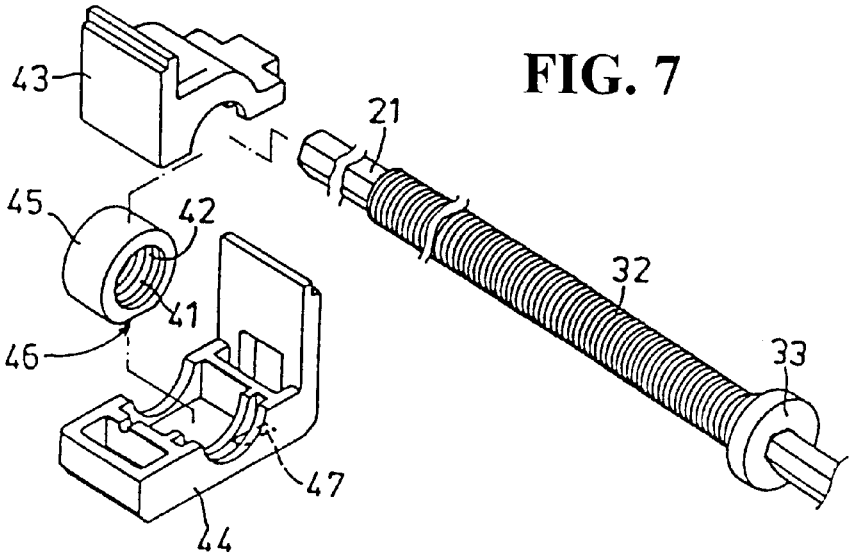
FIG. 7 is the partially enlarged view of the second preferred embodiment.

As shown in FIG. 7, the fixing stage 40 is composed of two sub-units 43 and 44 to form a groove receiving a nut 45. The nut 45 has cylindrical shape and has a surface 46 for clamping. The nut 45 receives the thread shaft 30 and meshed with the outer thread 32 of the shaft 30. A conduit 47 is provided on the lower unit 44 and between nut 45 and the stop part 33 for the passing of the cord 13.

Figure 8:
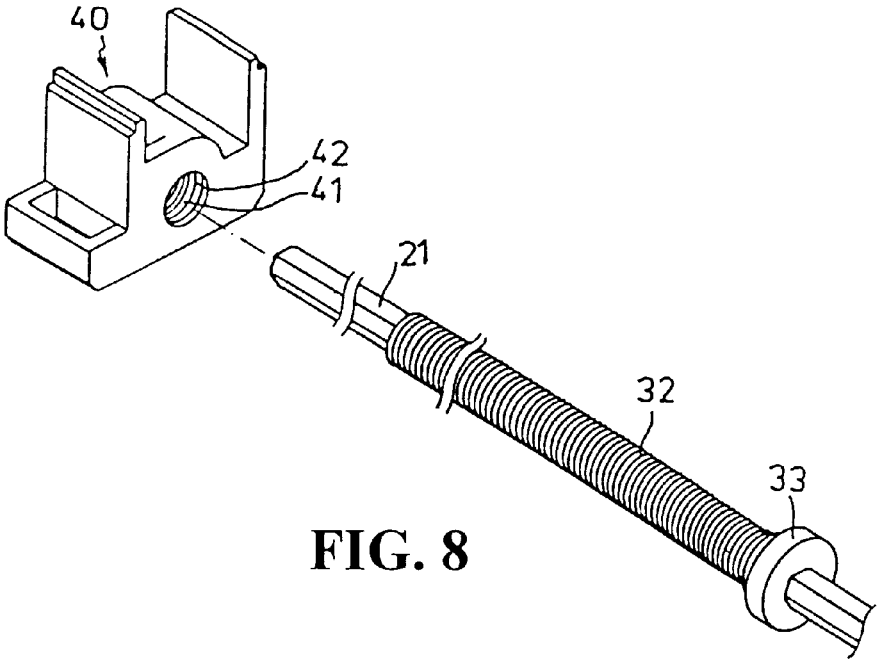
FIG. 8 is the partially enlarged view of the third preferred embodiment.

As shown in FIG. 8, the fixing stage 40 is integrally formed and has a through hole 41 with inner thread 42 to receive the thread shaft.

The two shafts 30 are connected to the transmission shaft 21 and synchronously relates with the shaft 21. The outer thread 32 of the shaft 30 has the same pitch as the inner thread 42 of the fixing stage 40. The lengths of cord 13 moving along the direction C1 and C2 are the same, and the cords 13 are received within the outer thread 32 such that the cords 13 can be uniformly wound.

When the curtain is lowered to the bottom point, the shaft 21 can not be rotated in the same direction. Therefore, the bottom point is definite.

The thread shaft 30 and the cord can be assembled independently, and then transmission shaft 21 and the fixing stage 40 are assembled, thus simplified the assembling operation.

Moreover, the thread shaft 30 can be integrally formed with the transmission shaft 21, and the shaft 21 and the driving means 20 are axially-sliding connected.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A winding device in combination with window covering comprising a curtain body having leaves and driven by a driving device to lift and lower the curtain body, said winding device comprising:

a transmission shaft linked with said driving device and driven by said driving device;

a plurality of threaded shafts connected with and rotated with said transmission shaft, said plurality of threaded shafts having threads thereon and having a stop edge on respective ends thereof;

a plurality of fixing stages each corresponding to one of said threaded shafts and arranged at predetermined positions on said curtain body, each of said fixing stages having a threaded through hole such that a respective one of said threaded shafts is received within said through hole, each of said fixing stages being composed of a nut clamped by two sub-units; and a plurality of guiding cords connected with said leaves of said curtain body, one end of each of said guiding cords being connected to one of said threaded shafts.

* * * * *